219-121 SR
3/4/80 XR 4,191,938

United States Patent [19]

Gow, 3rd et al.

[11] 4,191,938

[45] Mar. 4, 1980

[54] CERMET RESISTOR TRIMMING METHOD

[75] Inventors: John Gow, 3rd, Owego; Herman S. Hoffman, Apalachin; Earl Stephans, Chenango Forks, all of N.Y.

[73] Assignee: International Business Machines Corporation, Armonk, N.Y.

[21] Appl. No.: 921,291

[22] Filed: Jul. 3, 1978

[51] Int. Cl.[2] ..... H01C 10/00

[52] U.S. Cl. ..... 338/195; 29/620; 219/121 LM; 338/308

[58] Field of Search ..... 338/195, 308, 309; 219/121 LM; 29/620

[56] References Cited

U.S. PATENT DOCUMENTS

| | | | |
|---|---|---|---|
| 3,573,703 | 4/1971 | Burks et al. | 338/195 X |
| 3,768,150 | 10/1973 | Buie | 219/121 LM X |
| 3,864,825 | 2/1975 | Holmes | 29/620 X |
| 3,916,144 | 10/1975 | Schuermann | 219/121 LM |
| 3,947,801 | 3/1976 | Bube | 338/308 |

OTHER PUBLICATIONS

H. S. Hoffman et al., *IBM Technical Disclosure Bulletin,* "Thin Film Resistor Design", vol. 21, No. 6, Nov. 1978, pp. 2279–2280.

*Primary Examiner*—C. L. Albritton
*Attorney, Agent, or Firm*—Gerald R. Gugger

[57] ABSTRACT

A method for laser trimming of resistors which includes sputter depositing or vaporizing resistor material in a limited area but the resistor geometry and trimming location is designed to achieve a maximum resistor trimming range with a minimum substrate area occupied by the resistor. A cermet resistor is fabricated on a metallized ceramic substrate with the resistor having a low length to width ratio. A laser cut is used to provide resistor values greater than 250 ohms and up to 16000 ohms.

8 Claims, 8 Drawing Figures

CERMET RESISTOR TRIMMING METHOD

BACKGROUND OF THE INVENTION

Film resistors are commonly used in printed circuits and include thick film resistors which are conventionally formed by screen printing a resistive material on an insulating substrate and then firing the material and thin film resistors which are conventionally formed by sputtering or vacuum depositing a resistive material on an insulating substrate. In printed circuits it is often necessary to adjust the resistance of the film resistors in the circuit. To increase the resistance of a film resistor the resistor is "trimmed" by forming a cut across the electrical current path in the resistor to make the effective width of the resistor smaller and thereby increase the resistance. The cut may be formed by mechanical abrasion, chemical etching, or laser vaporization of the resistor material. The advantages of laser trimming over mechanical or chemical trimming include very high production rates, greater flexibility in functional trimming and tighter tolerances.

Current methods to laser trim thin film resistors, such as cermet (CrSiO) include:

(1) Pulse trimming—A current is pulsed through the resistor which changes the resistor value by altering the structure and composition of the material. The maximum charge from the original resistor value is approximately 50%.

(2) Laser annealing—The resistor is annealed by a low intensity beam spot which changes the resistor value. The mechanism to change the resistor value is equivalent to pulse trimming since the net effect is to heat the resistor. Again, the maximum change in resistance is approximately 50%.

(3) Network trimming—A resistor pattern is produced with lines connected in both series and parallel loops. The laser deletes connecting loops which alters the resistor length. This method has the capability for making resistors with a large potential resistor range, i.e. several decades, but the resistors require a substantial amount of substrate area.

(4) The resistor material is vaporized in a limited area to decrease the resistor width thereby increasing the resistor value. With conventional methods, change capability is approximately 50% to 100% from the original resistor value.

In the present printed circuit technology, use is made of metallized ceramic modules which are connected on the printed circuit board or card and which contain at least one integrated circuit chip. In one application of interest, it is desired to have a plurality of "so-called" terminating resistors on a one inch square metallized ceramic substrate with the resistors connected between the chip and input/output pins. It is also desired, for example, to have some of the resistors at 750 ohms and some of them at 7500 ohms. In attempting to meet these specifications, thick film paste resistors having a thickness in the order of 240 K angstroms were tried out. In paste resistors, each paste is equal to a certain value and it was necessary to mix more than one paste. Also, when trimming paste the resistance excursion can only be about threefold and still maintain stability. This necessitated the costly stocking of a plurality of substrates having different part numbers. In addition, it was found that the paste resistors had to be applied to one side of the substrate first and then the metallization applied to the other side because the metallization cannot stand up to the firing temperature of the paste, which is in the order of 800° C. This resulted in double masking which was time consuming and made the release of the package too costly.

It became evident that a method was needed which would allow the resistors and metallization to be applied to one side of the substrate and which would allow a substantially larger resistor trimming excursion.

SUMMARY OF THE INVENTION

The present invention makes use of cermet (CrSiO) thin film resistors. Cermet is a thin film, in the order of 1000 angstroms, has good stability and requires a thinner laser cut. The resistor is laster trimmed by vaporizing the material in a limited area to decrease the width of the resistor which results in increasing the resistor value. However, the resistor geometry and trimming location is designed to achieve a maximum resistor trimming range with a minimum substrate area occupied by the resistor. A cermet resistor having a low aspect ratio, i.e. a low length to width ratio, is fabricated on a metallized ceramic substrate. The sheet resistance of the material is established at 1000 ohms per square and the material is connected to suitable electrodes. The number of squares is determined by the ratio of the length to the width of the material. The resistor is trimmed by making laser cuts which changes the geometry and makes it possible to create many squares. As a result, a high trim excursion range is available to provide a wide range of resistance values. This trim range flexibility makes it possible to use only one substrate part number despite the fact that a large resistor range is required for terminating pins. Also, previously the terminating resistors were placed on the printed circuit cards which accept the modules. The present resistor is placed on the module substrate which results in a large cost saving.

Accordingly, a primary object of the present invention is to provide a novel and improved method of trimming cermet resistors wherein the resistor geometry and trimming location is designed to achieve a maximum resistor trimming range with a minimum substrate area occupied by the resistor.

Another object of the present invention is to provide a cermet resistor having a sheet resistance of 1000 ohms per square and having a low length to width ratio which can be laser trimmed to create many squares.

A still further object of the present invention is to provide a cermet resistor having a sheet resistance of 1000 ohms per square and having a length to width ratio of 1 to 4 which can be laser trimmed to provide resistor values of 250 ohms to 16000 ohms.

The foreoing and other objects, features and advantages of the invention will be apparent from the following more particular description of a preferred embodiment of the invention, as illustrated in the accompanying drawings.

DESCRIPTION OF PREFERRED EMBODIMENT

Figure 1:
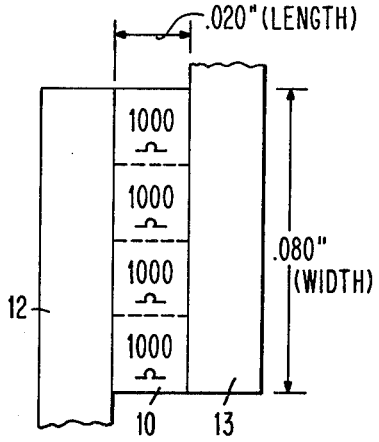
FIG. 1 is a schematic plan view illustrating an untrimmed cermet resistor having a geometry in accordance with the present invention.
Figure 2:
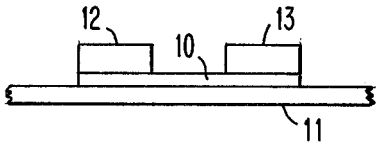
FIG. 2 is a schematic elevation view of the resistor of FIG. 1.

Referring to FIGS. 1 and 2, there is shown schematically an untrimmed cermet resistor having a preferred geometry in accordance with the present invention. The resistor 10 is a thin film cermet material having a preferred composition of 62% Cr and 38% SiO. The sheet resistivity of cermet material is a function of the composition and the greater the amount of SiO, the higher the resistivity. An operating range of 70% Cr-30% SiO to 50% Cr–50% SiO could be used; however, the preferred composition of 62% Cr–38% SiO provides the greatest flexibility for trimming and for resistor design.

In the present application, the cermet film 10 is deposited on a 1 inch square ceramic substrate 11 which serves as the base for a metallized ceramic module. A completed module (not shown) would contain an integrated circuit chip, metallized circuitry, a plurality of I/O or input-output pins, and a plurality of the present cermet resistors which function as terminating resistors between the chip and the I/O pins.

The cermet resistor film 10 is preferably deposited in blanket form on the ceramic substrate 11 by sputtering because it is a low cost operation and it lends itself to high volume manufacturing capability. This is carried out by an in-line high rate magnetron sputtering process using a machine manufactured by the Materials Research Corporation. The thickness range of the film could be from 500 to 1500 angstroms and for the present application the preferred thickness is 1000 angstroms. The sheet resistivity of the cermet material can vary from 700 to 3000 ohms per square prior to trimming. The sputtering was given a conventional 4-point probe test and adjusted to provide an operating value of 1000 ohms per square.

Following the sputtering operation, a blanket layer of Cr-Cu-Cr is evaporated on the cermet film. Then, using conventional photoresist application and selective etching steps, the Cr-Cu-Cr and cermet layers are personalized to provide a plurality of the cermet resistors 10 each having Cr-Cu-Cr electrodes 12 and 13. As shown in FIG. 1, resistor 10 is preferably given a geometry of 0.020 inches in length (the current path between electrodes) and 0.080 inches in width. This provides an aspect or length to width ratio of 1 to 4. The cermet is preferably plasma etched to obtain a tighter tolerance and less drift with life. A resistor tolerance of ±2% is possible in the present cermet process, as set forth. Also, plasma etching is much more environmentally sound with negligible pollution.

The resistance value of the cermet film depends on the number of squares which varies in accordance with the ratio between the length and the width of the resistor. Since the resistor in FIG. 1 has a sheet resistance of 1000 ohms per square and an aspect or length to width ratio of 1 to 4, prior to being trimmed, it has a resistor value of $\frac{1}{4}$ square which is equal to 250 ohms.

As was mentioned, it is desired to provide resistors which can be tailored to have a wide range of resistance values and yet take up a minimum amount of real estate on the substrate. For example, in one application, it is desired to have a plurality of terminating resistors on a module some of which have a value of 750 ohms and others a value of 7500 ohms. A wide range of resistance values is obtained by using the above-described resistor geometry and laser trimming to change the geometry and vary the number of squares.

To carry out the laser trimming, a Model 25 Laser Trimming Machine is used which is manufactured by Electro Scientific Industries. The output at the focal point is 1 watt and a laser beam generated by yttrium-aluminum-garnate is used to produce the desired wave length which penetrates the cermet resistor material but has negligible penetration of the ceramic substrate. A 0.001 inch wide laser cut is made which frees more real estate for trimming.

Figure 3:
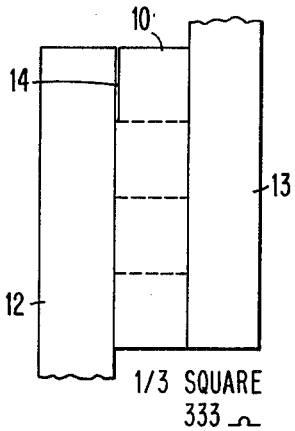
FIGS. 3–5 are schematic plan views of the resistor of FIG. 1 laser trimmed to create different numbers of resistor squares in parallel between the resistor electrodes.
Figure 4:
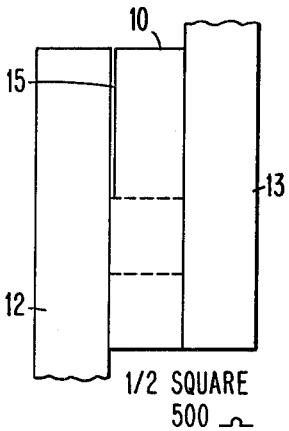
Figure 5:
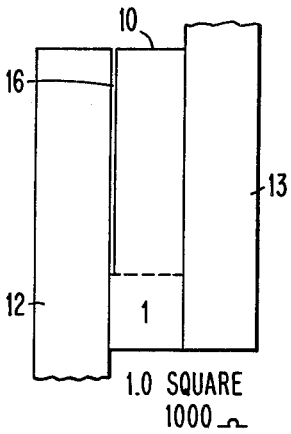

As shown in FIG. 1, the untrimmed resistor 10 has a length of 0.020 inches and a width of 0.080 inches to make a $\frac{1}{4}$ square which equals 250 ohms. FIGS. 3–5 show resistor 10 laser trimmed to vary the number of squares in parallel with the electrodes to increase the resistance. In FIG. 3, a laser cut 14 is made to make the length to width ratio 0.020 inches to 0.060 inches producing a $\frac{1}{3}$ square which equals 333 ohms. In similar fashion, the laser cut 15 in FIG. 4 produces a $\frac{1}{2}$ square which equals 500 ohms and the laser cut 16 in FIG. 5 produces 1 square which equals 1000 ohms.

Figure 6:
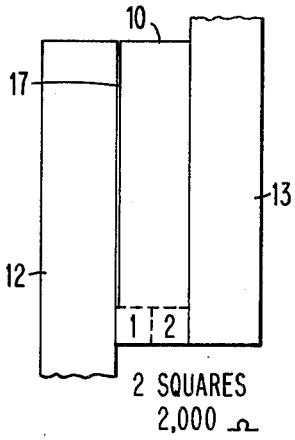
FIGS. 6–8 are schematic plan views of the resistor of FIG. 1 laser trimmed to create different numbers of resistor squares in series between the resistor electrodes.
Figure 7:
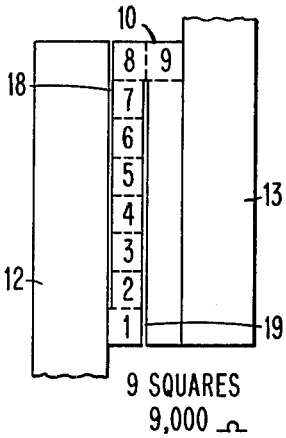
Figure 8:
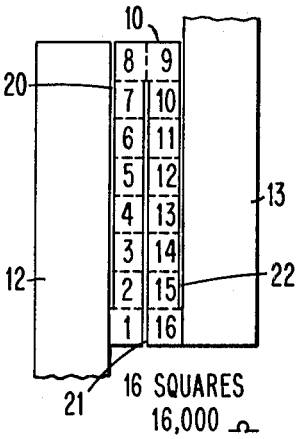

FIGS. 6–8 show resistor 10 laser trimmed to vary the number of squares in series with the electrodes to further increase the resistance. In FIG. 6, the laser cut 17 is made to make the length to width ratio 0.020 inches to 0.010 inches producing a current path of 2 squares between the electrodes which equals 2000 ohms. In FIG. 7, laser cuts 18 and 19 are made to make a current path of 9 squares between the electrodes which results in a resistance of 9000 ohms and in FIG. 8 laser cuts 20, 21 and 22 are made to produce a current path of 16 squares and a resistance of 16000 ohms.

It can be seen that by employing the present resistor geometry and the 0.001 inch wide laser cuts, a wide range of resistor values can be obtained using a minimum amount of substrate real estate. It will also be understood that other resistor dimensions which have a low aspect ratio could be used, as well as a different width and length size of laser cuts.

While the invention has been particularly shown and described with reference to a preferred embodiment thereof, it will be understood by those skilled in the art that various changes in form and details may be made therein without departing from the spirit and scope of the invention.

Having thus described our invention, what we claim as new, and desire to secure by Letters Patent is:

1. A method of trimming a thin film resistor which comprises the steps of:

fabricating on a substrate a thin film resistor material having a low length to width ratio;

establishing the sheet resistance of said material at 1000 ohms per square; and laser trimming said material to provide resistor values from 250 ohms to 16000 ohms.

2. A method of trimming a thin film resistor which comprises the steps of:

fabricating on a substrate a thin film resistor material having a low length to width ratio;

establishing the sheet resistance of said material at 1000 ohms per square; and laser trimming said material to vary the number of squares and vary the resistance of said material.

3. The method as set forth in claim 2 wherein said thin film resistor material is cermet and the laser trimming is carried out by making laser cuts to vary the number of squares of cermet material.

4. A method of trimming a thin film resistor which comprises the steps of:

fabricating on a substrate a thin film cermet resistor material having a low length to width ratio of 1 to 4;

establishing the sheet resistance of said cermet material at 1000 ohms per square; and making 0.001 inch wide laser cuts of said cermet material to vary the number of squares of the cermet material and accordingly vary the resistance thereof.

5. A method of trimming a thin film resistor which comprises the steps of:

fabricating on a substrate a thin film resistor material having a low length to width ratio;

establishing the sheet resistance of said material at 1000 ohms per square;

fabricating conductive electrodes which contact said resistor material; and laser trimming said resistor material to create a varying number of squares in parallel or in series with said electrodes to provide a range of resistance values for said resistor.

6. A method of trimming a thin film resistor which comprises the steps of:

fabricating on a substrate a thin film resistor of cermet material having a length to width ratio of 1 to 4 to equal $\frac{1}{4}$ square;

establishing the sheet resistance of said material at 1000 ohms per square;

fabricating conductive electrodes which contact said resistor material along the width thereof; and laser trimming said resistor by making linear cuts to selectively increase the number of squares in said resistor and increase the resistance value thereof.

7. The method of trimming as set forth in claim 6 wherein said linear cuts may be made to increase the number of squares in parallel or in series with said electrodes.

8. A method of trimming a thin film resistor which comprises the steps of:

fabricating on a substrate a thin film resistor of cermet material having a composition in the range of 70% Cr–30% SiO to 50% Cr–50% SiO and having a length to width ratio of 1 to 4 to equal $\frac{1}{4}$ square;

fabricating conductive electrodes which contact said resistor material along the width thereof; and laser trimming said resistor by making linear cuts which are operable to create a range of $\frac{1}{4}$ square to 16 squares between said electrodes whereby the resistance of said resistor may be adjusted in the range of 250 ohms to 16000 ohms.

* * * * *